US010663885B2

(12) United States Patent
Yoshioka

(10) Patent No.: US 10,663,885 B2
(45) Date of Patent: May 26, 2020

(54) DEVELOPING DEVICE AND IMAGE FORMING APPARATUS

(71) Applicant: FUJI XEROX CO., LTD., Tokyo (JP)

(72) Inventor: Sakae Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/950,188

(22) Filed: Apr. 11, 2018

(65) Prior Publication Data

US 2019/0018339 A1 Jan. 17, 2019

(30) Foreign Application Priority Data

Jul. 13, 2017 (JP) ..... 2017-137405

(51) Int. Cl.
*G03G 15/08* (2006.01)

(52) U.S. Cl.
CPC ..... *G03G 15/087* (2013.01); *G03G 15/0889* (2013.01); *G03G 15/0891* (2013.01); *G03G 2215/0663* (2013.01)

(58) Field of Classification Search
CPC ..... G03G 15/087; G03G 15/0865; G03G 15/0877
See application file for complete search history.

(56) References Cited

U.S. PATENT DOCUMENTS 7,187,876 B2 * 3/2007 Ito ..... G03G 15/0862 399/258
7,522,851 B2 * 4/2009 Koyama ..... G03G 15/0868 399/258

FOREIGN PATENT DOCUMENTS

JP 2012-150246 8/2012

* cited by examiner

*Primary Examiner* — David M. Gray
*Assistant Examiner* — Andrew V Do
(74) *Attorney, Agent, or Firm* — JCIPRNET

(57) ABSTRACT

A developing device includes a container containing developer, into which toner is supplied from a supply port provided in the upper part of the container; and a rotary member disposed so as to oppose the supply port and having a projection on the circumference thereof, the rotary member transporting the developer and accumulating the developer in the supply port when the level of the surface of the developer inside the container is higher than or equal to a threshold height, and the rotary member transporting the toner from the supply port to the container through a path formed between the rotary member and the container by pushing the toner with the projection when the level of the surface is lower than the threshold height.

6 Claims, 14 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-137405 filed Jul. 13, 2017.

BACKGROUND

Technical Field

The present invention relates to a developing device and an image forming apparatus.

SUMMARY

According to an aspect of the invention, there is provided a developing device including: a container containing developer, into which toner is supplied from a supply port provided in an upper part of the container; and a rotary member disposed so as to oppose the supply port and having a projection on a circumference thereof, the rotary member transporting the developer and accumulating the developer in the supply port when a level of the surface of the developer inside the container is higher than or equal to a threshold height, and the rotary member transporting the toner from the supply port to the container through a path formed between the rotary member and the container by pushing the toner with the projection when the level of the surface is lower than the threshold height.

BRIEF DESCRIPTION OF THE DRAWINGS

Exemplary embodiments of the present invention will be described in detail based on the following figures, wherein.

DETAILED DESCRIPTION

Figure 1A:
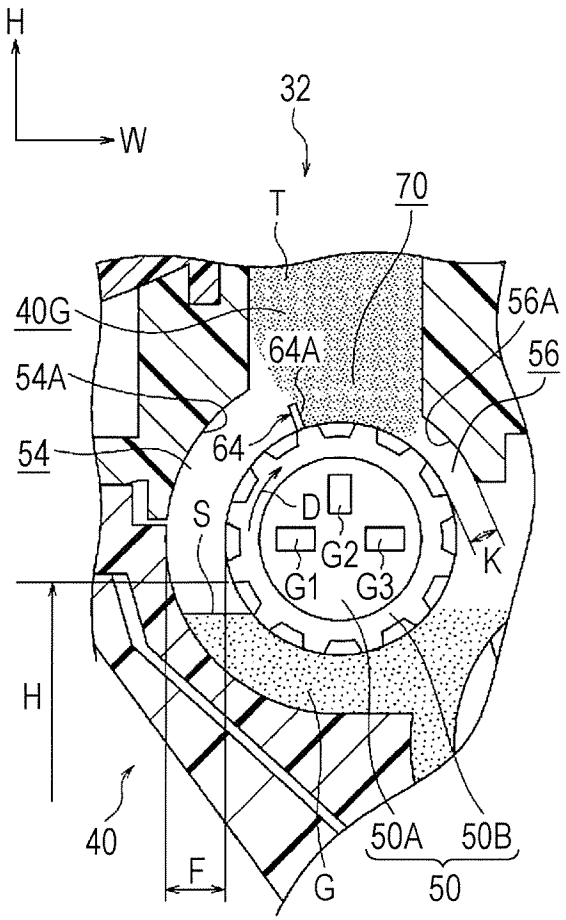
FIGS. 1A, 1B, and 1C show the operation of a developing device according to a first exemplary embodiment of the present invention.

An example of a developing device and an example of an image forming apparatus according to a first exemplary embodiment of the present invention will be described with reference to FIGS. 1 to 10. In the drawings, arrows H show the vertical direction, which corresponds the top-bottom direction of the apparatus, arrows W show the horizontal direction corresponding to the width direction of the apparatus, and arrows D show the horizontal direction corresponding to the depth direction of the apparatus.

Overall Configuration

Figure 8:
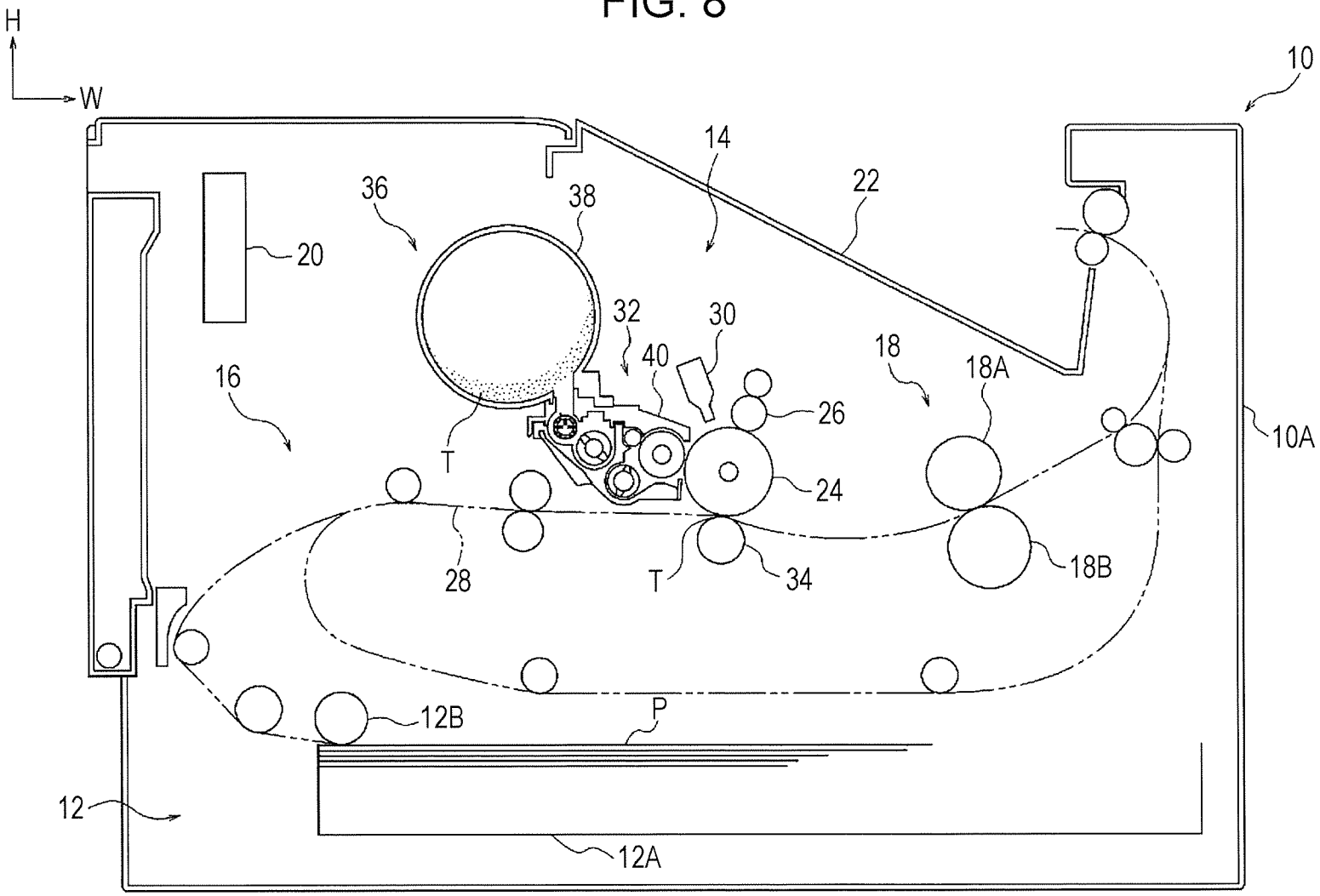
FIG. 8 schematically shows the configuration of an image forming apparatus according to the first exemplary embodiment of the present invention.

As shown in FIG. 8, an image forming apparatus 10 includes an apparatus body 10A, which accommodates: a storage part 12, which accommodates sheets P, serving as recording media; a transport part 16 that transports the sheets P accommodated in the storage part 12; an image forming unit 14 that forms a toner image on a sheet P transported thereto; a fixing part 18 that fixes the toner image formed on the sheet P by the image forming unit 14 to the sheet P; and a controller 20 that controls the operations of the respective parts of the image forming apparatus 10.

The apparatus body 10A has, at the top thereof, a discharge part 22, on which the sheet P having an image fixed thereto by the fixing part 18 is discharged.

Image Forming Unit

The image forming unit 14 is located in the middle inside the apparatus body 10A in the top-bottom direction. The image forming unit 14 includes an image carrier 24 that carries an image, a charging roller 26 that charges the image carrier 24, and an exposure device 30 that exposes the image carrier 24 charged by the charging roller 26 to the light to form an electrostatic latent image on the image carrier 24. The image forming unit 14 further includes a developing device 32 that develops the electrostatic latent image on the image carrier 24 into a toner image with developer G, which contains toner T and carrier, and a toner cartridge 36 that accommodates the toner T to be supplied to the developing device 32. The image forming unit 14 further includes a transfer roller 34 that transfers the toner image on the image carrier 24 to the transported sheet P.

Details of the developing device 32 and the toner cartridge 36 will be described below.

Storage Part

The storage part 12 is disposed at the lower part of the image forming unit 14. The storage part 12 includes a loading member 12A on which the sheets P are loaded, and a feed roller 12B that feeds the sheet P at the top of the sheets P loaded on the loading member 12A.

Transport Part

The transport part 16 includes multiple transport rollers (reference sign omitted) that transport the sheet P fed by the feed roller 12B along a transport path 28, along which the sheets P are transported.

Fixing Part

The fixing part 18 is located on the side of the image forming unit 14. The fixing part 18 includes a heating roller 18A for heating the toner image transferred to the sheet P, and a pressure roller 18B that is in contact with and is driven (rotated) by the heating roller 18A, the heating roller 18A and the pressure roller 18B transporting the sheet P nipped therebetween.

Effect of Overall Configuration

Next, an image forming operation for forming an image on a sheet P will be described.

A sheet P is fed from the loading member 12A by the feed roller 12B and is transported to a transfer position T formed between the image carrier 24 and the transfer roller 34.

In the image forming unit 14, the exposure device 30 exposes the image carrier 24 charged by the charging roller 26 to the light, thus forming an electrostatic latent image on the image carrier 24. The electrostatic latent image is developed by the developing device 32, and thus, a toner image is formed on the image carrier 24. The toner image is transferred by the transfer roller 34 to the sheet P transported to the transfer position T.

The sheet P to which the toner image has been transferred is transported to the fixing part 18, where the toner image is fixed to the sheet P. Then, the sheet P is discharged on the discharge part 22.

Configuration of Relevant Parts

Next, the developing device 32 and the toner cartridge 36 will be described.

Developing Device

Figure 5:
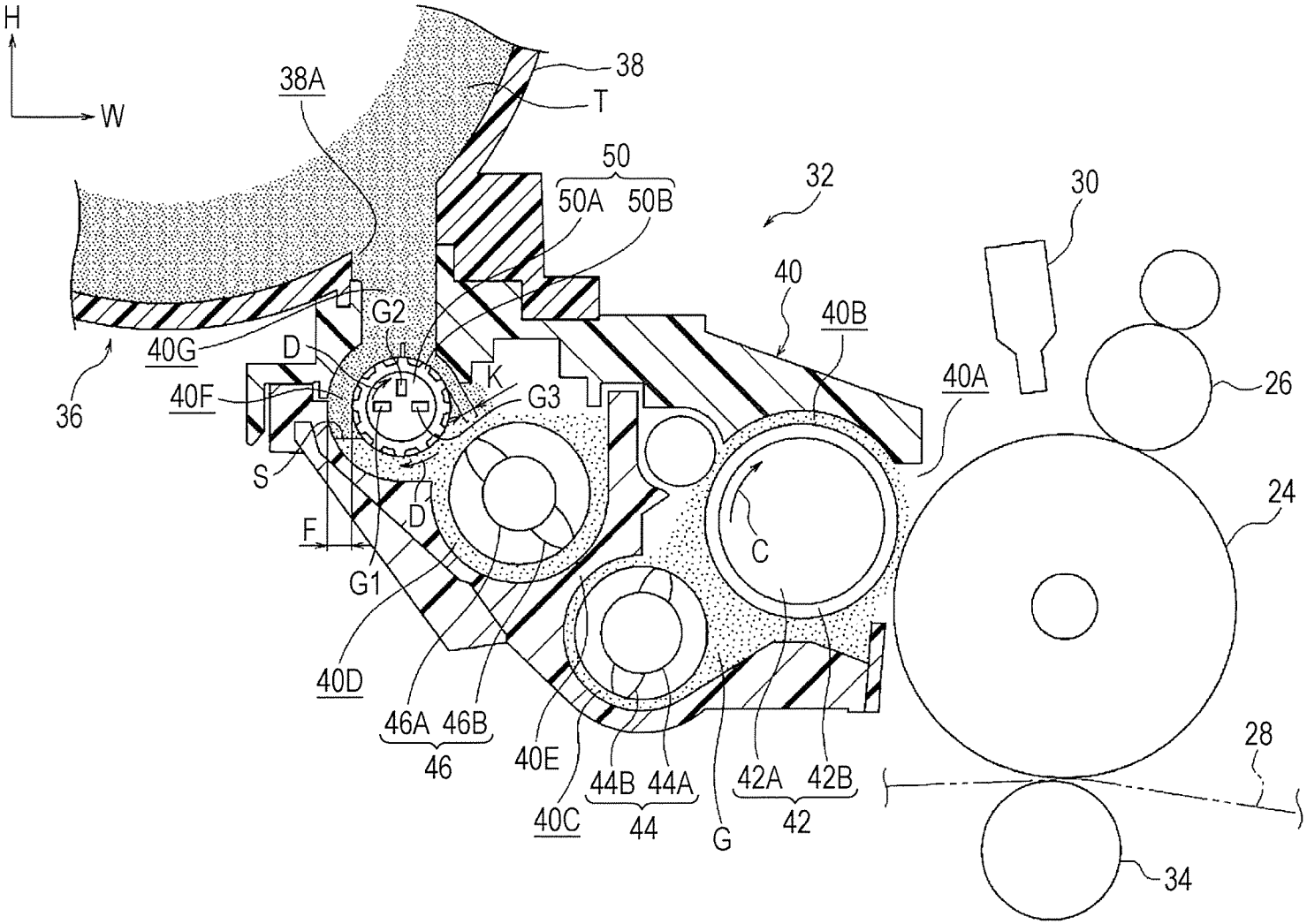
FIG. 5 is a sectional view of the developing device and other components according to the first exemplary embodiment of the present invention.

As shown in FIG. 5, the developing device 32 includes a housing 40 that accommodates the developer G, a developing roller 42 disposed so as to oppose the image carrier 24, a supply auger 44 for supplying the developer G to the developing roller 42, and a stirring auger 46 for stirring the developer G. The developing device 32 further includes a magnetic roller 50 for supplying the toner T into the housing 40. The housing 40 is an example of a container.

The developer G is a two-component developer that is basically composed of the toner T and magnetic carrier particles (hereinbelow, "carrier C").

Housing

The housing 40 is located next to the image carrier 24. The housing 40 has, at a portion facing the image carrier 24, an opening 40A extending in the depth direction of the apparatus, via which the interior of the housing 40 is open to the outside.

In the interior of the housing 40, a delivery path 40B extending in the depth direction of the apparatus, in which the developing roller 42 is located, is formed on the opposite side of the opening 40A from the image carrier 24. In the interior of the housing 40, a supply path 40C extending in the depth direction of the apparatus, in which the supply auger 44 is located, is formed on the opposite side of the delivery path 40B from the opening 40A, at a position obliquely below the delivery path 40B.

In the interior of the housing 40, a stirring path 40D extending in the depth direction of the apparatus, in which the stirring auger 46 is located, is formed on the opposite side of the supply path 40C from the delivery path 40B, at a position obliquely above the supply path 40C. In the interior of the housing 40, a partition wall 40E dividing the supply path 40C and the stirring path 40D is provided between the supply path 40C and the stirring path 40D.

Figure 4:
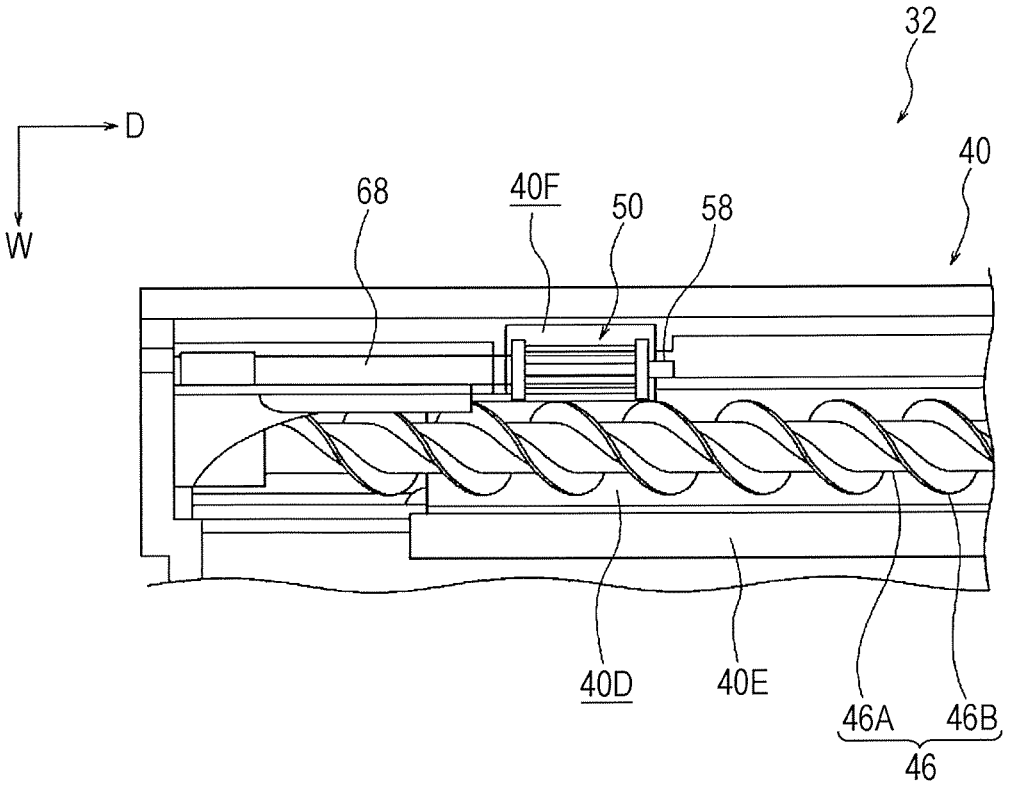
FIG. 4 is a plan view of the interior of the developing device according to the first exemplary embodiment of the present invention.

As shown in FIGS. 4 and 5, in the interior of the housing 40, a supply path 40F, in which the magnetic roller 50 is located, is formed on the near side in the depth direction of the apparatus, on the opposite side of the stirring path 40D from the supply path 40C. Furthermore, as shown in FIG. 5, in the interior of the housing 40, a passage 40G extending in the top-bottom direction and through which the toner T to be supplied to the interior of the housing 40 passes is formed above the supply path 40F. A portion of the supply path 40F facing the passage 40G serves as a supply port 70 through which the toner T is supplied from the passage 40G to the interior of the housing 40.

Supply Path, Stirring Path, and Partition Wall

The supply path 40C and the stirring path 40D are formed of wall surfaces that are arc-shaped in sectional view. The partition wall 40E divides the supply path 40C and the stirring path 40D, except for the far-side and near-side portions in the depth direction of the apparatus. In the housing 40, communication paths communicating between the supply path 40C and the stirring path 40D are provided at the far-side and near-side portions of the supply path 40C in the depth direction of the apparatus.

Supply Path and Passage

Figure 3:
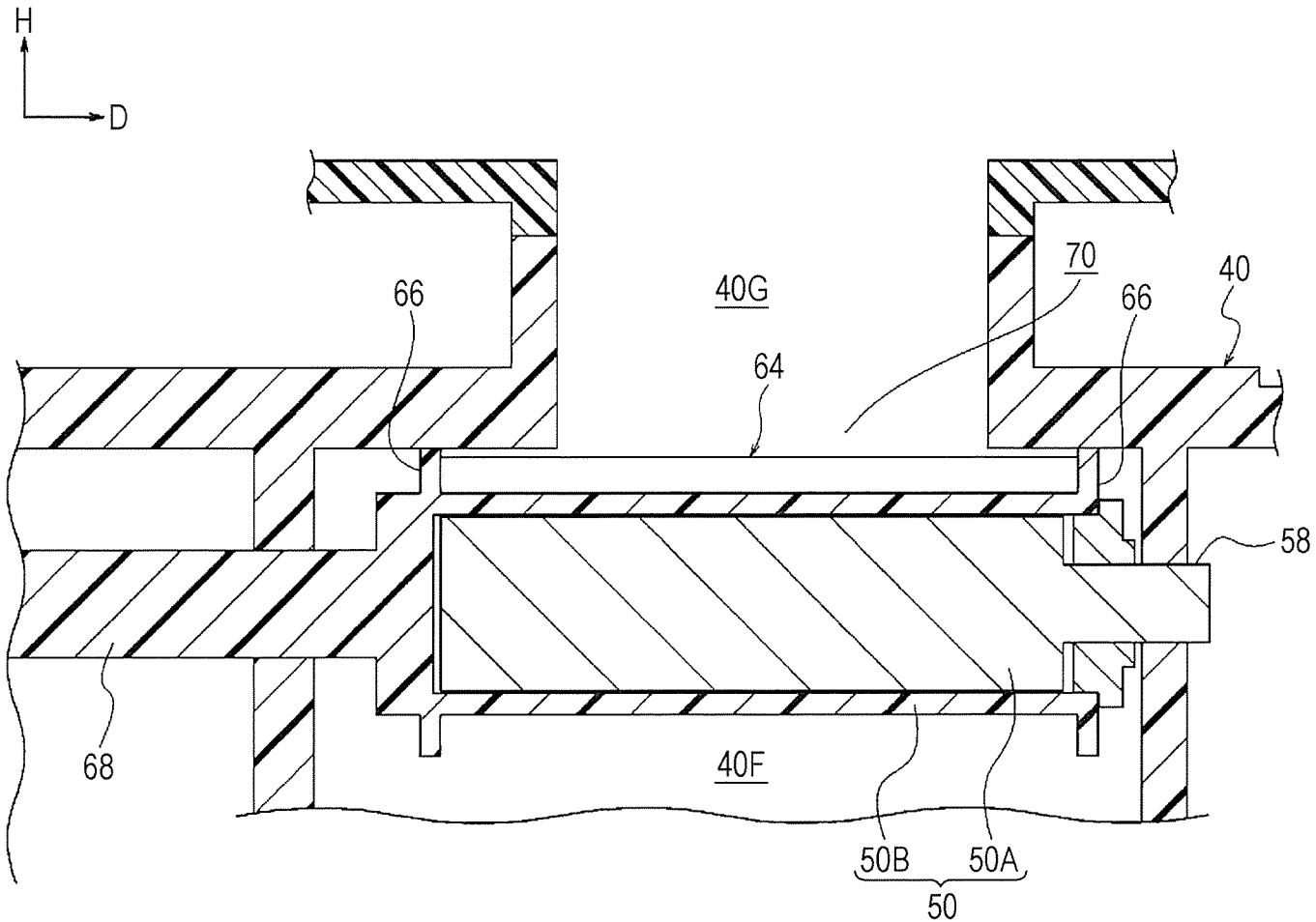
FIG. 3 is a sectional view of the developing device according to the first exemplary embodiment of the present invention.

The supply path 40F is formed of a wall surface that is arc-shaped in sectional view. As shown in FIG. 4, the supply path 40F is continuous with the stirring path 40D in the depth direction of the apparatus. The passage 40G has a rectangular shape (not shown) extending in the depth direction of the apparatus in plan view. As shown in FIG. 3, the dimension of the passage 40G in the depth direction of the apparatus is smaller than that of the supply path 40F. As shown in FIG. 5, the dimension of the passage 40G in the width direction of the apparatus is smaller than that of the supply path 40F.

Developing Roller

As described above, the developing roller 42 extends in the depth direction of the apparatus and is located in the delivery path 40B. There is a gap (development gap) between the developing roller 42 and the image carrier 24, through which the developer G is delivered from the developing roller 42 to the image carrier 24.

Figure 6:
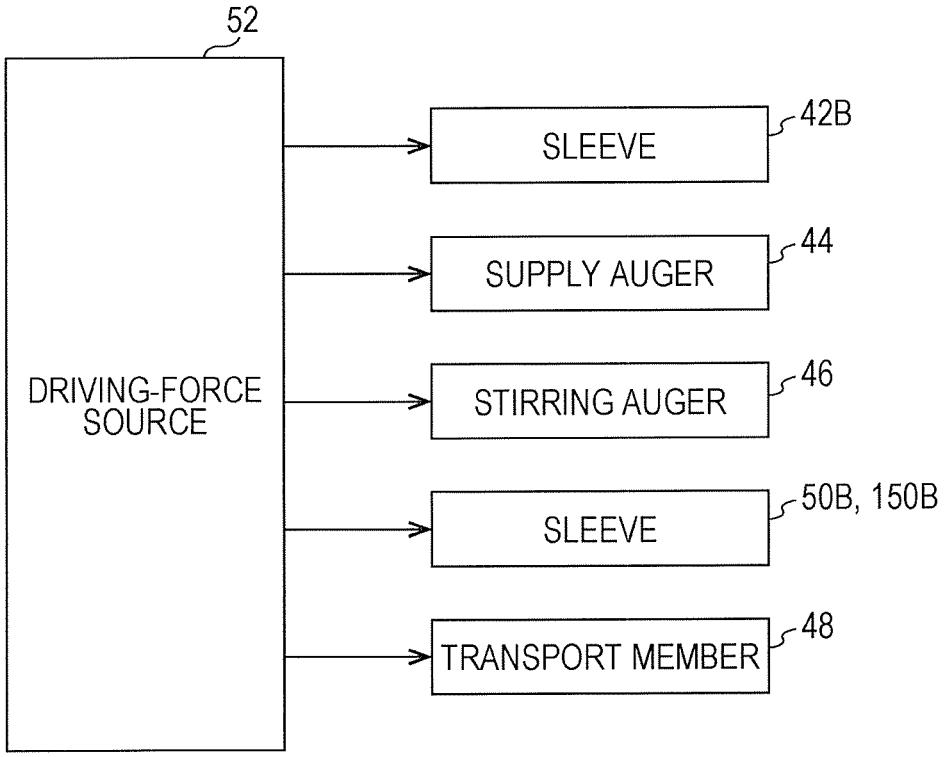
FIG. 6 is a block diagram showing transmission paths of a driving force supplied from a driving-force source provided in the developing device according to the first exemplary embodiment of the present invention.

The developing roller 42 includes a magnet roller 42A having a circular section and a sleeve 42B provided on and rotating around the magnet roller 42A. The sleeve 42B is rotated in an arrow C direction (clockwise) in FIG. 5 by a rotational force transmitted from a driving-force source 52 (see FIG. 6). FIG. 6 shows members to which the driving-force source 52 transmits rotational forces.

In this configuration, a magnetic brush of the developer G is formed on the circumference of the rotating sleeve 42B by the magnetic force of the magnet roller 42A. The rotating sleeve 42B transports the magnetic brush of the developer G. The toner T contained in the developer G and transported to a position facing the image carrier 24 is attracted to the image carrier 24, thus developing an electrostatic latent image into a visible toner image.

Supply Auger

As described above, the supply auger 44 extends in the depth direction of the apparatus and is located in the supply path 40C. The supply auger 44 includes a supply shaft 44A extending in the depth direction of the apparatus and a helical supply blade 44B formed on the circumference of the supply shaft 44A. The supply auger 44 is rotated by a rotational force transmitted from the driving-force source 52 (see FIG. 6).

In this configuration, the rotating supply auger 44 transports, while stirring, the developer G toward one side in the depth direction of the apparatus and supplies the developer G to the developing roller 42.

Stirring Auger

As described above, the stirring auger 46 extends in the depth direction of the apparatus and is located in the stirring path 40D. The stirring auger 46 includes a stirring shaft 46A extending in the depth direction of the apparatus and a helical stirring blade 46B formed on the circumference of the stirring shaft 46A. The stirring auger 46 is rotated by a rotational force transmitted from the driving-force source 52 (see FIG. 6).

In this configuration, while rotating, the stirring auger 46 stirs and transports the developer G toward the other side in the depth direction of the apparatus and receives and passes the developer G from and to the supply auger 44 through the communication paths located on the near side and the far side in the depth direction of the apparatus. This way, the supply auger 44 and the stirring auger 46 circulate the developer G between the supply path 40C and the stirring path 40D.

Magnetic Roller 50

The magnetic roller 50 extends in the depth direction of the apparatus and is disposed in the supply path 40F, at a position below the supply port 70. The outside diameter of the magnetic roller 50 is larger than the dimension of the supply port 70 in the width direction of the apparatus. As shown in FIG. 1A, at least a portion of the lower part of the magnetic roller 50 is located below a surface S of the developer G accommodated in the housing 40.

The magnetic roller 50 includes a magnet roller 50A having a circular section and a sleeve 50B provided on and rotating around the magnet roller 50A. The sleeve 50B is rotated in an arrow D direction (clockwise) in FIG. 1A by a rotational force transmitted from the driving-force source 52 (see FIG. 6). The sleeve 50B is an example of a rotary member.

An arc-shaped first path 54 and an arc-shaped second path 56 are formed upstream and downstream, respectively, of a portion of the magnetic roller 50 facing the passage 40G in the direction in which the sleeve 50B rotates (hereinbelow, "sleeve-rotation direction"). More specifically, the first path 54 is formed between the wall surface 54A of the housing 40 and the sleeve 50B, and the second path 56 is formed between the wall surface 56A of the housing 40 and the sleeve 50B. The second path 56 is an example of the path.

In this exemplary embodiment, the width of the first path 54 (the dimension F in FIG. 1A) is larger than the width of the second path 56 (the dimension K in FIG. 1A). The width of the second path 56 is 1 mm.

Magnet Roller 50A

Figure 2:
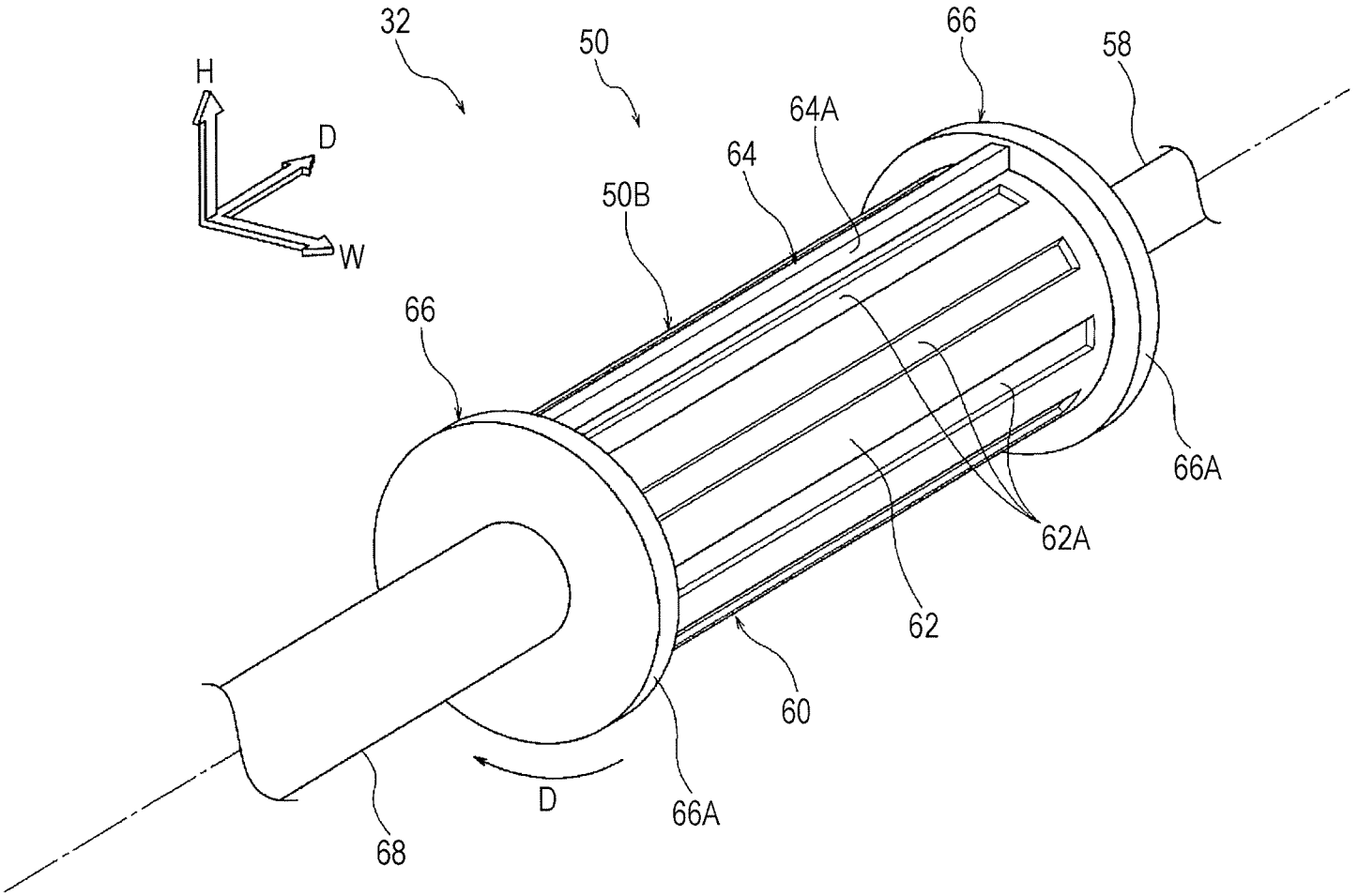
FIG. 2 is a perspective view of a magnetic roller provided in the developing device according to the first exemplary embodiment of the present invention.

The magnet roller 50A has a cylindrical shape extending in the axial direction and is fixed to the housing 40 via a shaft part 58 (see FIGS. 2 and 3).

The magnet roller 50A has a magnetic pole G1 (pickup pole) at a portion facing the first path 54. When the level of the surface S of the developer G is higher than or equal to a predetermined threshold height H, the magnetic pole G1 attracts, against the gravity, the developer G located on and above the threshold height H and allows the developer G to attach to a circumference 62 of a body 60 (described in detail below) of the sleeve 50B.

The magnet roller 50A also has a magnetic pole G2 (transport pole) at a portion facing the passage 40G. The magnetic pole G2 has a polarity opposite to the polarity of the magnetic pole G1. Thus, a bundle of magnetic lines of force (magnetic field) directed from the magnetic pole G1 to the magnetic pole G2 is formed. Due to this magnetic field, the developer G is kept attached to the circumference 62 of the body 60 of the sleeve 50B.

The magnet roller 50A also has a magnetic pole G3 (separation pole) at a portion on the opposite side of the center of the magnet roller 50A from the magnetic pole G1. The magnetic pole G3 has the same polarity as the magnetic pole G1. Thus, a bundle of repelling magnetic lines of force (magnetic field) is formed between the magnetic pole G1 and the magnetic pole G3. Due to this magnetic field, the developer G attached to the circumference 62 of the body 60 of the sleeve 50B is released from the sleeve 50B.

In this exemplary embodiment, the magnetic pole G1 and the magnetic pole G3 are N poles, and the magnetic pole G2 is an S pole.

Sleeve 50B

The sleeve 50B is made of resin. As shown in FIG. 2, the sleeve 50B includes the cylindrical body 60, a projection 64 formed on the circumference 62 of the body 60, and flanges 66 formed at both ends of the body 60 in the depth direction of the apparatus. The sleeve 50B also includes a shaft part 68 extending from the near side of the body 60 in the depth direction of the apparatus.

The shaft part 68 constitutes the rotation shaft of the sleeve 50B. As described above, when the rotational force is transmitted from the driving-force source (see FIG. 6) to the shaft part 68, the sleeve 50B rotates in the arrow D direction (clockwise).

The body 60 has a larger diameter than the shaft part 68. Grooves 62A having a trapezoidal section and extending in the depth direction of the apparatus are provided in the circumference 62 of the body 60. The grooves 62A are provided from one end portion to the other end portion of the body 60 in the depth direction of the apparatus. The grooves 62A are arranged at equal intervals (pitch) in the circumferential direction of the body 60. The grooves 62A in the circumference 62 of the body 60 increase the frictional force in the sleeve-rotation direction generated between the circumference 62 of the body 60 and the toner T transported to the interior of the housing 40.

In this exemplary embodiment, the outside diameter of the body 60 is 8 mm, the depth of the grooves 62A is 0.3 mm, and the width of the grooves 62A is 1.5 mm.

The projection 64 is a plate projecting in the radial direction of the body 60 from the circumference 62 of the body 60 and extends from one end to the other end of the body 60 in the depth direction of the apparatus. The projection 64 has a wall surface 64A facing downstream in the sleeve-rotation direction. The wall surface 64A is an example of an outer wall surface. What is meant by "facing downstream in the sleeve-rotation direction" is that the wall surface 64A faces a direction within −10° to +10° from the tangent of the base end of the projection 64 of the body 60, as viewed from the axial direction.

The height of the projection 64 is 70% or more of the width of the second path 56. In this exemplary embodiment, the height is 0.7 mm. Accordingly, the projection 64 is a projecting portion that has a height from the circumference 62 of 70% or more of the width of the second path 56 (i.e., the minimum path width).

As described above, the flanges 66 are provided at both ends of the body 60 in the depth direction of the apparatus and have a disc-like shape. The flanges 66 are provided at positions different from the position of the supply port 70 in the depth direction of the apparatus. The outside diameter of the flanges 66 is larger than the outside diameter of the body 60. In this exemplary embodiment, the outside diameter of the flanges 66 is 10 mm. The height of the flanges 66 is larger than the height of the projection 64. With this configuration, when circumferences 66A of the flanges 66 and the wall surface 56A (see FIG. 1) of the housing 40, which forms the second path 56, come into contact with each other, the width of the second path 56 is ensured. The flanges 66 serve as spacers for ensuring the width of the second path 56.

Toner Cartridge

As shown in FIG. 8, the toner cartridge 36 includes a cylindrical body part 38 and a transport member 48 (see FIG. 6) provided inside the body part 38. The body part 38 extends in the depth direction of the apparatus and accommodates the toner T to be supplied to the interior of the housing 40 of the developing device 32. As shown in FIG. 5, the body part 38 has a supply port 38A through which the toner T is supplied from the toner cartridge 36 to the housing 40, the supply port 38A being provided at the upper end of the passage 40G.

The transport member 48 disposed inside the body part 38 is rotated by a rotational force transmitted from the driving-force source 52 (see FIG. 6).

In this configuration, the transport member 48 (see FIG. 6) transports the toner T inside the body part 38 toward the supply port 38A.

Effects of Relevant Parts

The effects of the relevant parts, as compared with a developing device 132 according to a comparison example, will be described. First, the configuration of the developing device 132 according to the comparison example that differs from the configuration of the developing device 32 according to this exemplary embodiment will be described. When the effect of the developing device 32 and the effect of the developing device 132 are the same, the effect of the developing device 132 will be described.

Figure 9A:
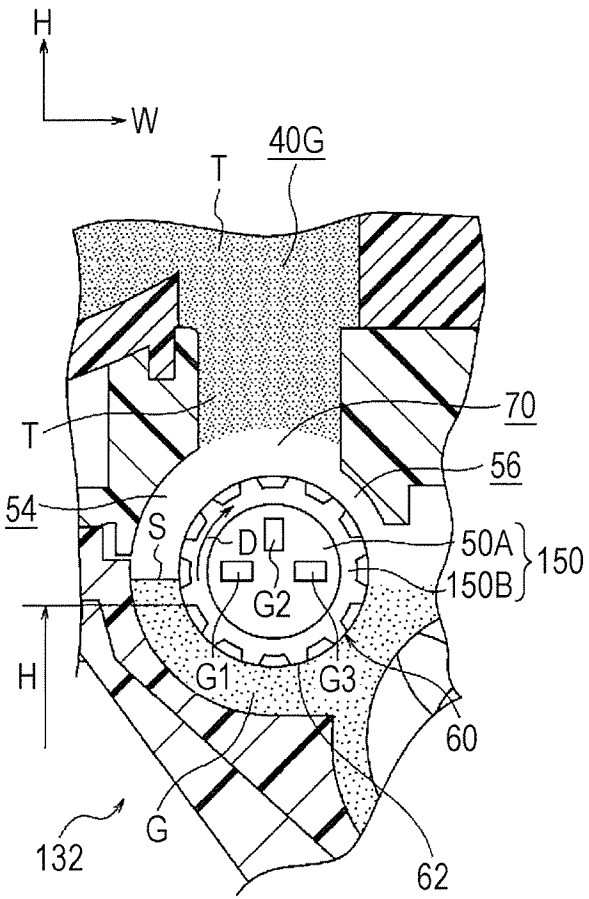
FIGS. 9A, 9B, and 9C show the operation of a developing device according to a comparison example, as compared with the developing device according the first exemplary embodiment of the present invention.

As shown in FIG. 9A, a magnetic roller 150 of the developing device 132 according to the comparison example includes a magnet roller 50A and a sleeve 150B provided on and rotating around the magnet roller 50A. The sleeve 150B has the same configuration as the sleeve 50B, except that the sleeve 150B does not have the projection 64 and the flanges 66.

When an image forming operation is started (i.e., when a job is started), the driving-force source 52 is activated, rotating the sleeve 42B, the supply auger 44, the stirring auger 46, the sleeve 150B, and the transport member 48 (see FIG. 6).

Figure 9B:
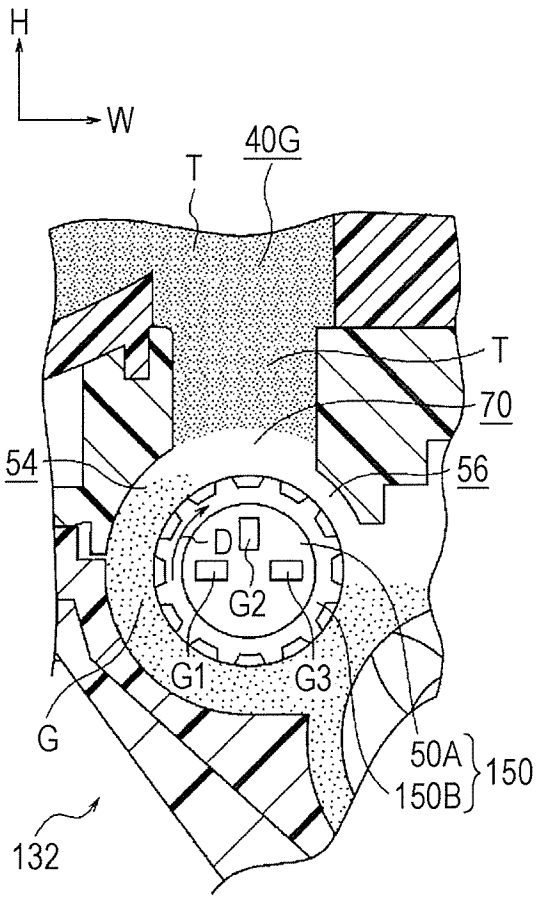
Figure 9C:
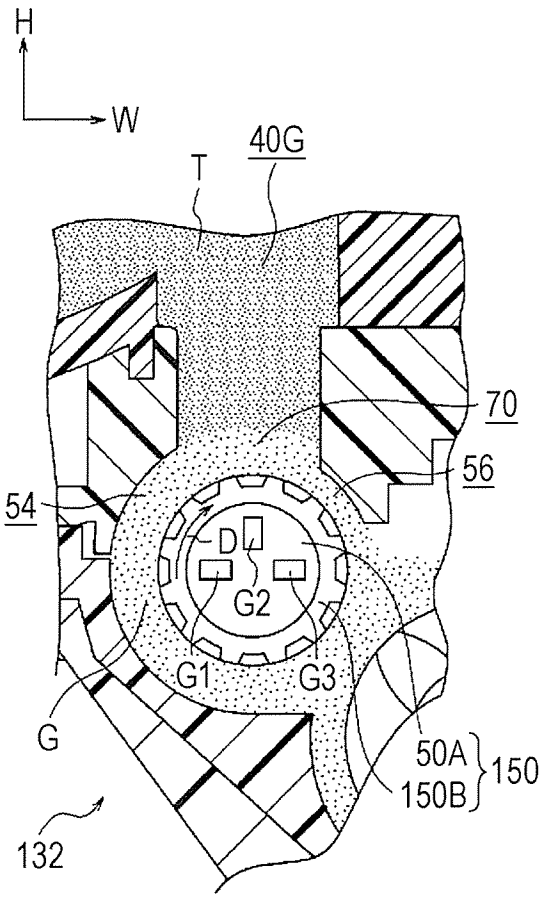

Due to the repulsive force generated between the toner T and the carrier, the apparent volume of the developer G in the housing 40 may be larger than the amount of the developer G actually supplied (increased). In that case, as shown in FIG. 9A, the level of the surface S of the developer G on the lower side of the magnetic roller 150 reaches or exceeds the predetermined threshold height H. FIGS. 9A, 9B, and 9C schematically show the movement of the developer G so that the movement of the developer G can be easily understood.

As a result, the magnetic pole G1 of the magnet roller 50A attracts, against the gravity, the developer G located above the threshold height H and allows the developer G to attach to the circumference 62 of the body 60 of the sleeve 150B. The developer G attached to the circumference 62 of the body 60 of the rotating sleeve 150B is transported to the supply port 70 through the first path 54, as shown in FIGS. 9A and 9B.

As described above, the width of the second path 56 located on the opposite side of the supply port 70 from the first path 54 is smaller than the width of the first path 54. Thus, as shown in FIGS. 9B and 9C, a portion of the developer G transported to the supply port 70 through the first path 54 passes through the second path 56 and is released from the sleeve 150B. Meanwhile, the other portion of the developer G transported to the supply port 70 through the first path 54 accumulates at the supply port 70. Thus, the toner T accumulates in the passage 40G, and thus, the supply of the toner T from the supply port 70 to the interior of the housing 40 is stopped.

Figure 10A:
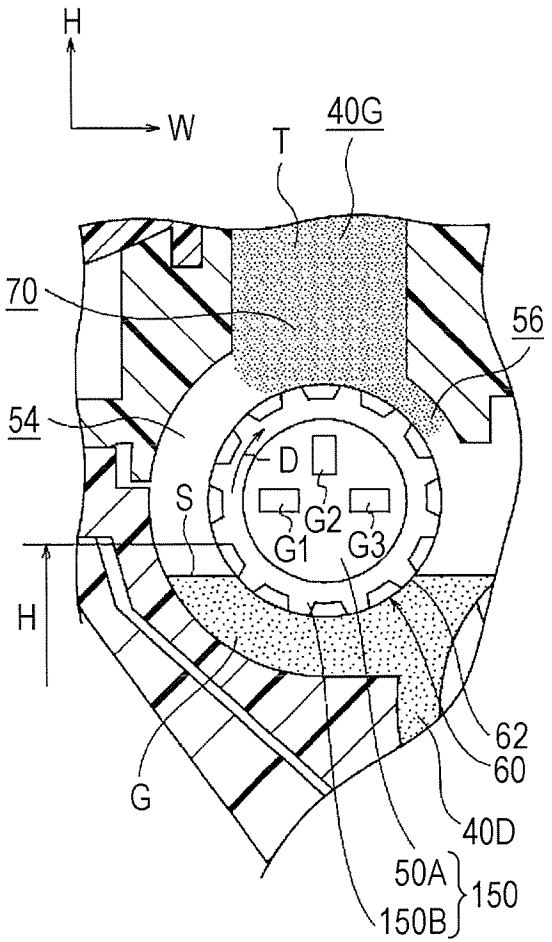
FIGS. 10A, 10B, and 10C show the operation of a developing device according to the comparison example, as compared with the developing device according the first exemplary embodiment of the present invention.
Figure 10B:
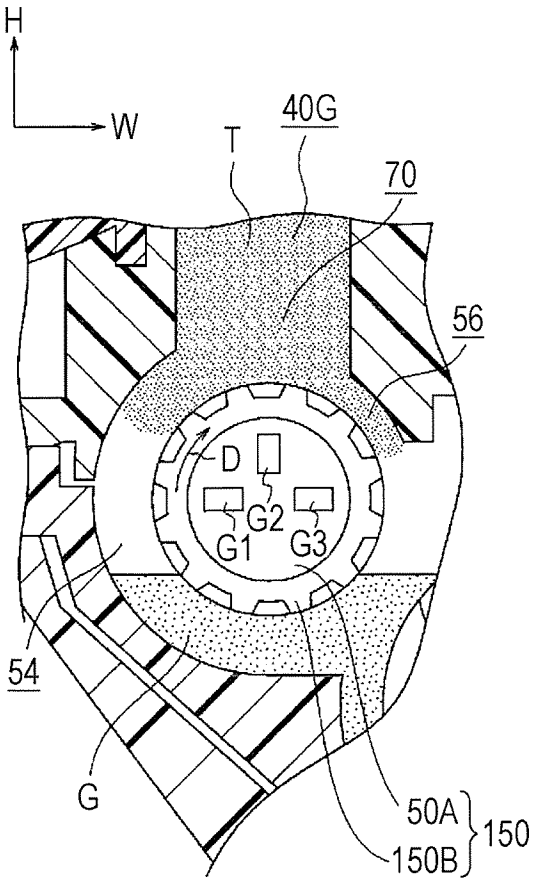
Figure 10C:
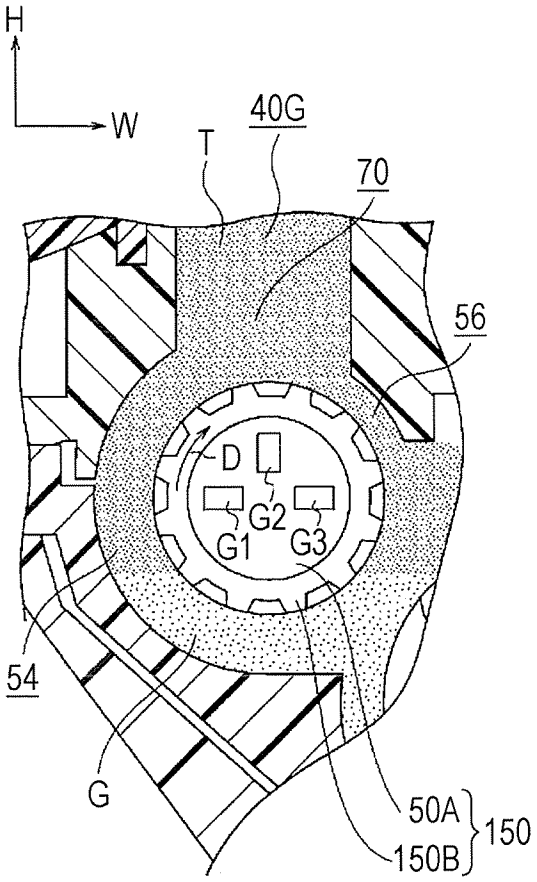

When the toner T in the housing 40 is consumed by image forming operations, the level of the surface S of the developer G on the lower side of the magnetic roller 150 drops below the predetermined threshold height H, as shown in FIG. 10A. FIGS. 10A, 10B, and 10C schematically show the movement of the toner T so that the movement of the toner T can be easily understood.

As a result, attachment of the developer G to the sleeve 150B due to the magnetic force of the magnetic pole G1 of the magnet roller 50A does not occur. Thus, the rotating sleeve 150B causes the developer G accumulating in the supply port 70 to pass through the second path 56 and to be released from the sleeve 150B.

The toner T accumulating in the passage 40G drops due to the gravity and flows into the first path 54 and the second path 56, as shown in FIGS. 10A and 10B. When the sleeve 150B rotates in the arrow D direction, the toner T is transported by the frictional force generated between the toner T and the circumference 62 of the body 60 of the sleeve 150B, passes through the second path 56, and is supplied to the interior of the housing 40.

While the rotating sleeve 150E is transporting the toner T, the toner T fills the grooves 62A formed in the circumference 62 of the body 60 of the sleeve 150B. As a result, the toner T slips on the circumference 62 of the body 60, causing the most toner T in the second path 56 to accumulate in the second path 56. This phenomenon is notable when multiple high area-coverage images are formed on sheets P under a high-temperature, high-humidity environment, causing a sharp drop of the toner density.

Figure 1B:
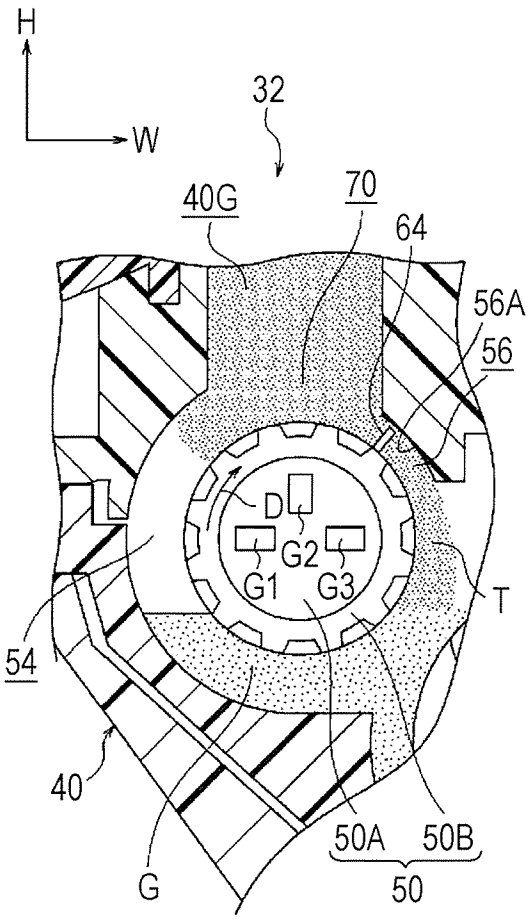
Figure 1C:
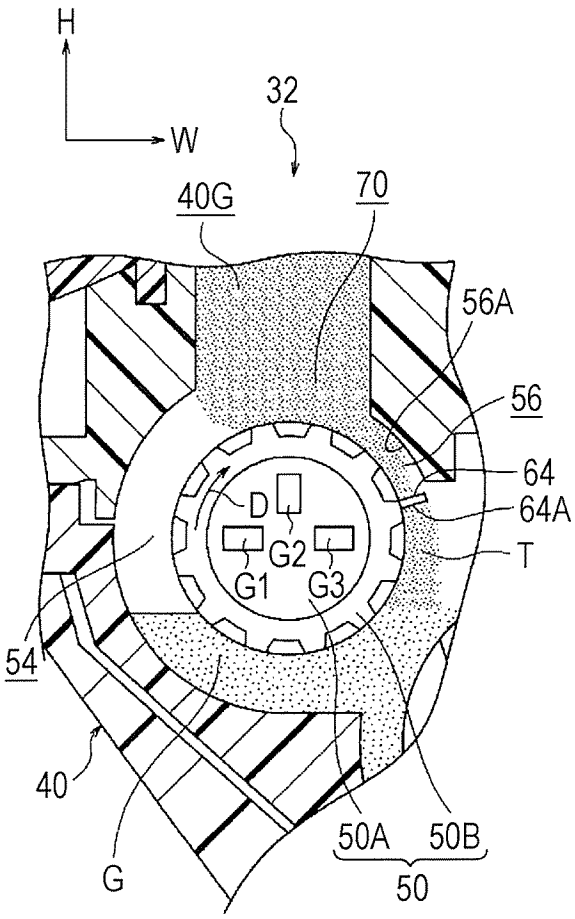

As shown in FIG. 1A, in the developing device 32, when the toner T in the housing 40 is consumed, the level of the surface S of the developer G on the lower side of the magnetic roller 50 drops below the predetermined threshold height H. FIGS. 1A, 1B, and 1C schematically show the movement of the toner T so that the movement of the toner T can be easily understood.

As a result, attachment of the developer G to the sleeve 50B due to the magnetic force of the magnetic pole G1 of the magnet roller 50A does not occur. Thus, the rotating sleeve 50B causes the developer G accumulating in the supply port 70 to pass through the second path 56 and to be released from the sleeve 50B.

As shown in FIGS. 1A and 1B, the toner T accumulating in the passage 40G drops due to the gravity and flows into the first path 54 and the second path 56. When the sleeve 50B rotates in the arrow D direction, the toner T is pushed toward the second path 56 by the wall surface 64A of the projection 64 formed on the circumference 62 of the body 60 of the sleeve 50B. The toner T pushed by the wall surface 64A of the projection 64 passes through the second path 56 and is transported (supplied) to the interior of the housing 40. The toner T supplied to the interior of the housing 40 is pushed into the developer G by the wall surface 64A.

The flanges 66 (see FIG. 2) formed on the sleeve 50B serve as spacers for ensuring the width of the second path 56.

The amount of the toner T supplied to the interior of the housing 40 in the developing device 32 and that in the developing device 132 are evaluated.

Figure 7:
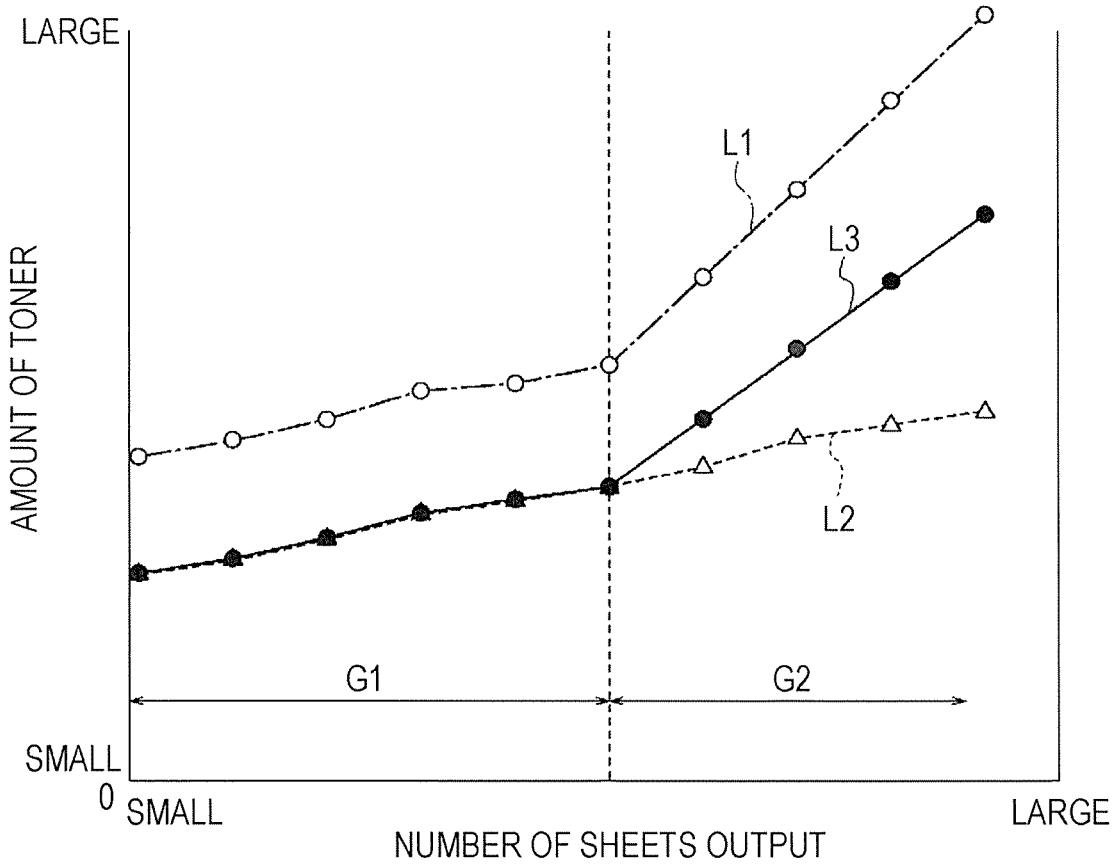
FIG. 7 shows results of evaluation of the developing device according to the first exemplary embodiment of the present invention and a developing device according to a comparison example.

FIG. 7 shows the results of evaluation performed with the developing device 32 and the developing device 132. The horizontal axis of the graph represents the number of sheets P output after toner images are formed thereon in the developing devices 32 and 132. The vertical axis of the graph represents the cumulative amount of toner consumed or supplied.

In the number of sheets output, in an area G1 in the graph, A4 size sheets P having black images with an area coverage of 20% are output, and in the area G2 in the graph, A4 size sheets P having black images with an area coverage of 40% are output.

The one-dot chain line L1 in the graph represents the amount of toner consumed by the developing devices 32 and 132.

The dashed line L2 in the graph represents the amount of toner supplied from the supply port 70 to the interior of the housing 40 in the developing device 132, and the solid line L3 in the graph represents the amount of toner supplied from the supply port 70 to the interior of the housing 40 in the developing device 32.

As can be seen from FIG. 7, when sheets P on which images having an area coverage of 40% (high area-coverage images) are formed by the developing device 132 are output, the amount of toner supplied decreases as compared with the amount of toner consumed.

Meanwhile, when sheets P on which images having an area coverage of 40% (high area-coverage images) are formed by the developing device 32 are output, the amount of toner supplied does not decrease as compared with the amount of toner consumed.

This may be because, as described above, in the developing device 132, the most toner T in the second path 56 accumulates in the second path 56.

CONCLUSION

As described above, in the developing device 32, compared with the developing device 132, in which the toner T is transported only by means of the frictional force between the toner T and the circumference 62 of the body 60, accumulation (stagnation) of the toner T in the second path 56 is reduced. In other words, in the developing device 32, the amount of the toner T supplied to the interior of the housing 40 is larger than that in the developing device 132.

Furthermore, because the toner T is supplied from the supply port 70 to the interior of the housing 40, variation in the density of the toner in the developer G inside the housing 40 is smaller than that in the developing device 132.

Furthermore, because the toner T in the second path 56 is transported, the second path 56 is cleaned.

The toner T supplied to the interior of the housing 40 is pushed into the developer G by the wall surface 64A in the interior of the housing 40. Thus, in the developing device 32, the toner T supplied to the interior of the housing 40 is more quickly mixed with the developer G than in the case where the developing device 132 is used.

The flanges 66 formed on the sleeve 50B serve as spacers for ensuring the width of the second path 56. Thus, contact between the tip of the projection 64 and the wall surface 56A of the second path 56 is reduced as compared with the case where the flanges 66 are not provided.

The height of the projection 64 is 0.7 mm, and the depth of the grooves 62A is 0.3 mm. That is, the height of the projection 64 is larger than the depth of the grooves 62A. Thus, the amount of the toner T supplied to the interior of the housing 40 is larger than that in the case where the height of the projection 64 is smaller than the depth of the grooves 62A.

The wall surface 64A of the projection 64 faces downstream in the sleeve-rotation direction. Thus, for example, the amount of the toner T supplied to the interior of the housing 40 is larger than that in the case where the wall surface of the projection is inclined with respect to the sleeve-rotation direction.

The flanges 66 are located at positions different from the position of the supply port 70 in the depth direction of the apparatus. Thus, the amount of the toner T supplied to the interior of the housing 40 is larger than that in the case where the flanges 66 are located at positions overlapping the position of the supply port 70 in the depth direction of the apparatus.

Furthermore, in the image forming apparatus 10, variation in the density of toner in the developer G is less likely to occur than that in the case where the developing device 32 is not provided. Hence, degradation in the output image is reduced.

Second Exemplary Embodiment

An example of a developing device and an example of an image forming apparatus according to a second exemplary embodiment of the present invention will be described below with reference to FIGS. 11 and 12. The configuration of the second exemplary embodiment that differs from the first exemplary embodiment will be described.

Figure 11:
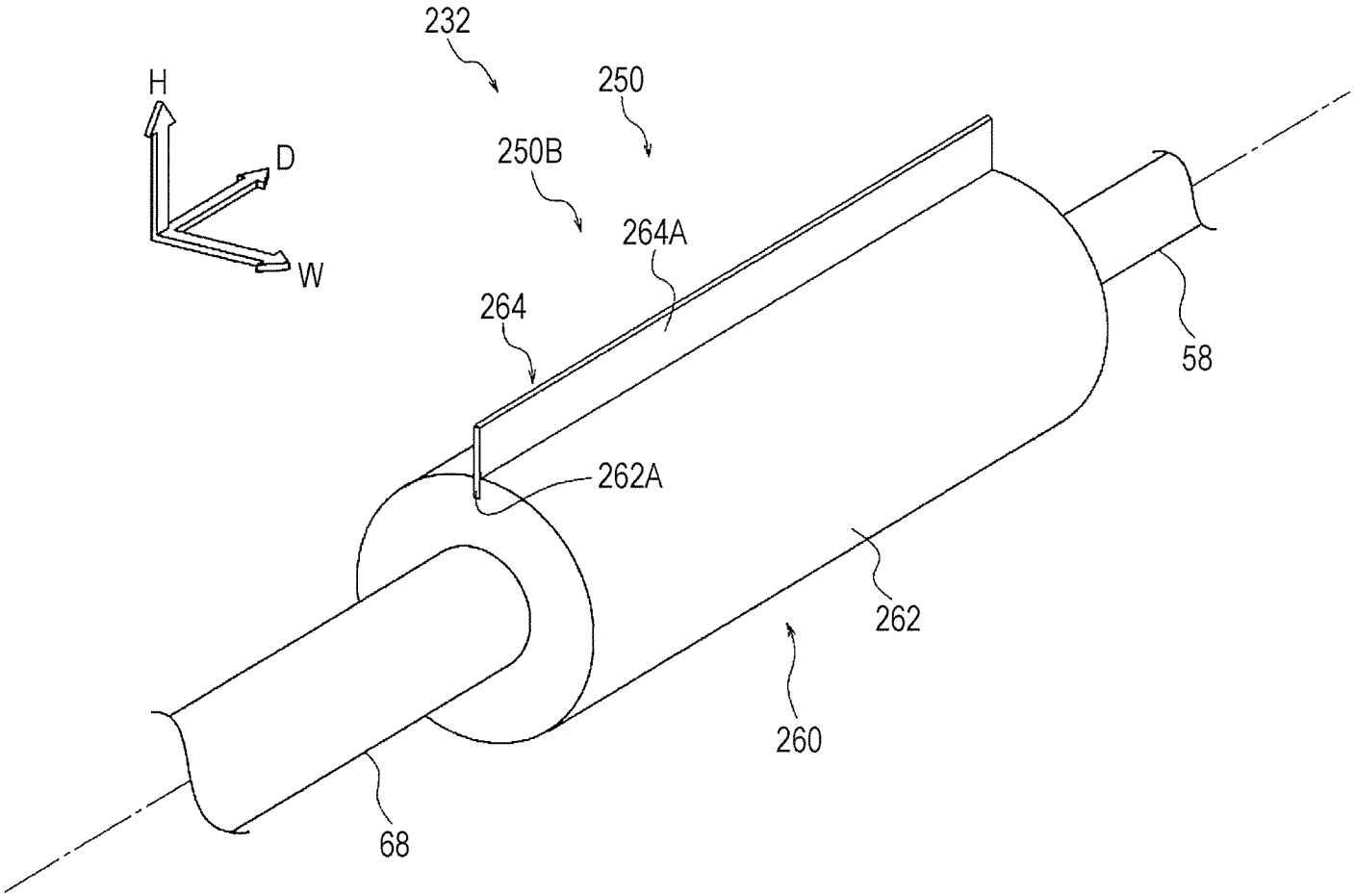
FIG. 11 is a perspective view of a magnetic roller provided in a developing device according to a second exemplary embodiment of the present invention.

As shown in FIG. 11, a sleeve 250B of a magnetic roller 250 provided in a developing device 232 according to the second exemplary embodiment includes a cylindrical body part 260, a shaft part 68 extending from the near side of the body part 260 in the depth direction of the apparatus, and a projection 264 that is made of a film. The "film" is a thin resin film having a thickness of 200 μm or less. The sleeve 250B is an example of a rotary member.

More specifically, one groove 262A extending in the depth direction of the apparatus (axial direction of the magnetic roller 250) is provided in a circumference 262 of the body part 260.

A projection 264 extending in the radial direction and axial direction of the magnetic roller 250 is formed by fitting the base end of a rectangular plate, which is made of a film and extends in the depth direction of the apparatus, into the groove 262A. The projection 264 has a wall surface 264A facing downstream in the sleeve-rotation direction. The wall surface 264A is an example of the outer wall surface. In this exemplary embodiment, the height of the projection 264 is 1.2 mm.

Figure 12:
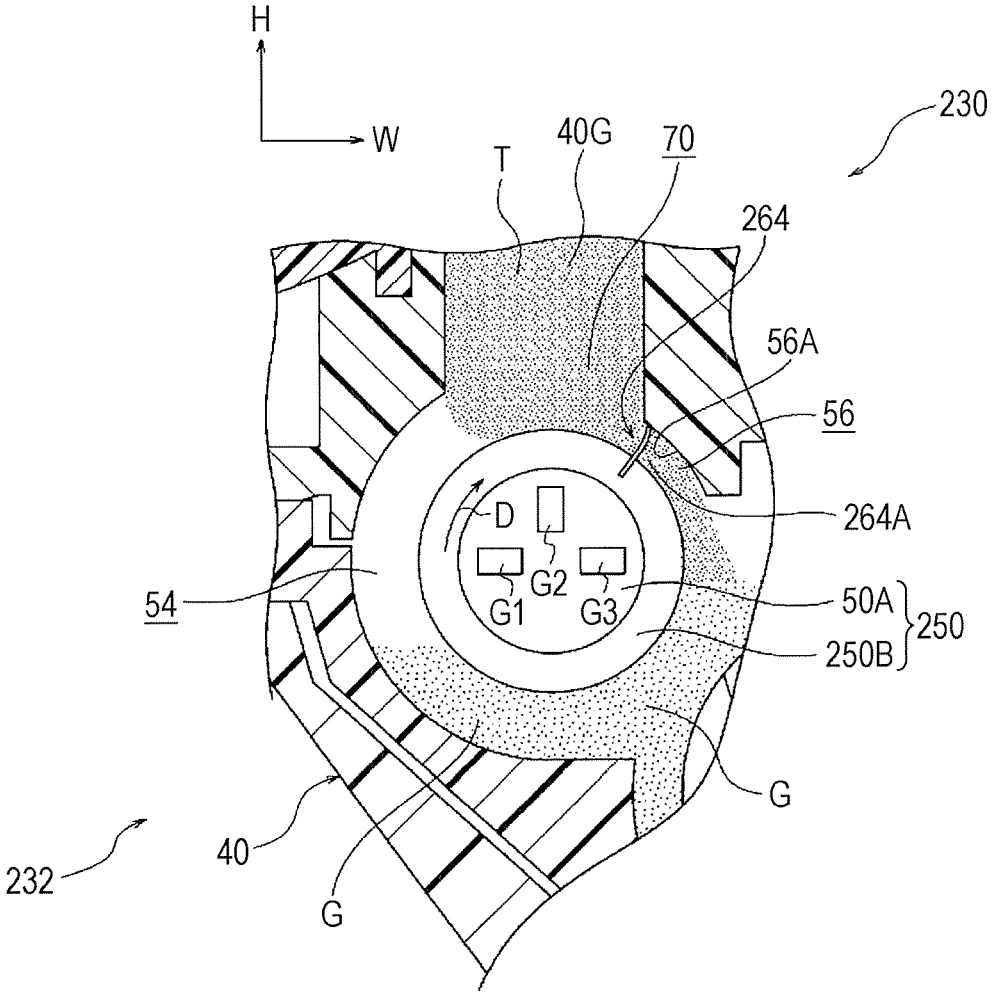
FIG. 12 is a sectional view of the developing device and other components according to the second exemplary embodiment of the present invention.

In this configuration, as shown in FIG. 12, when the sleeve 250B rotates in the arrow D direction, the toner T is pushed by the wall surface 264A of the projection 264, which is bent by being in contact with the wall surface 56A, which constitutes the second path 56. The toner T pushed by the wall surface 264A of the projection 264 is transported to the interior of the housing 40 through the second path 56.

By forming the projection 264 from a film, damage to another member, caused as a result of the projection 264 coming into contact with the other member, is reduced as compared with the case where projection 264 is made of, for example, metal.

Furthermore, the toner T is pushed by the wall surface 264A of the projection 264, which is bent by being in contact with the wall surface 56A, which constitutes the second path 56. Thus, deposition of the toner T on the wall surface 56A is reduced.

The sleeve 250B does not have flanges that serve as spacers for ensuring the width of the second path 56. Thus, the width of the second path 56 may become smaller than the specification value. However, in that case, the projection 264 is bent more, reducing damage to the wall surface 56A of the second path 56.

Third Exemplary Embodiment

An example of a developing device and an example of an image forming apparatus according to a third exemplary embodiment of the present invention will be described with reference to FIG. 13. The configuration of the third exemplary embodiment that differs from the first exemplary embodiment will be described.

Figure 13:
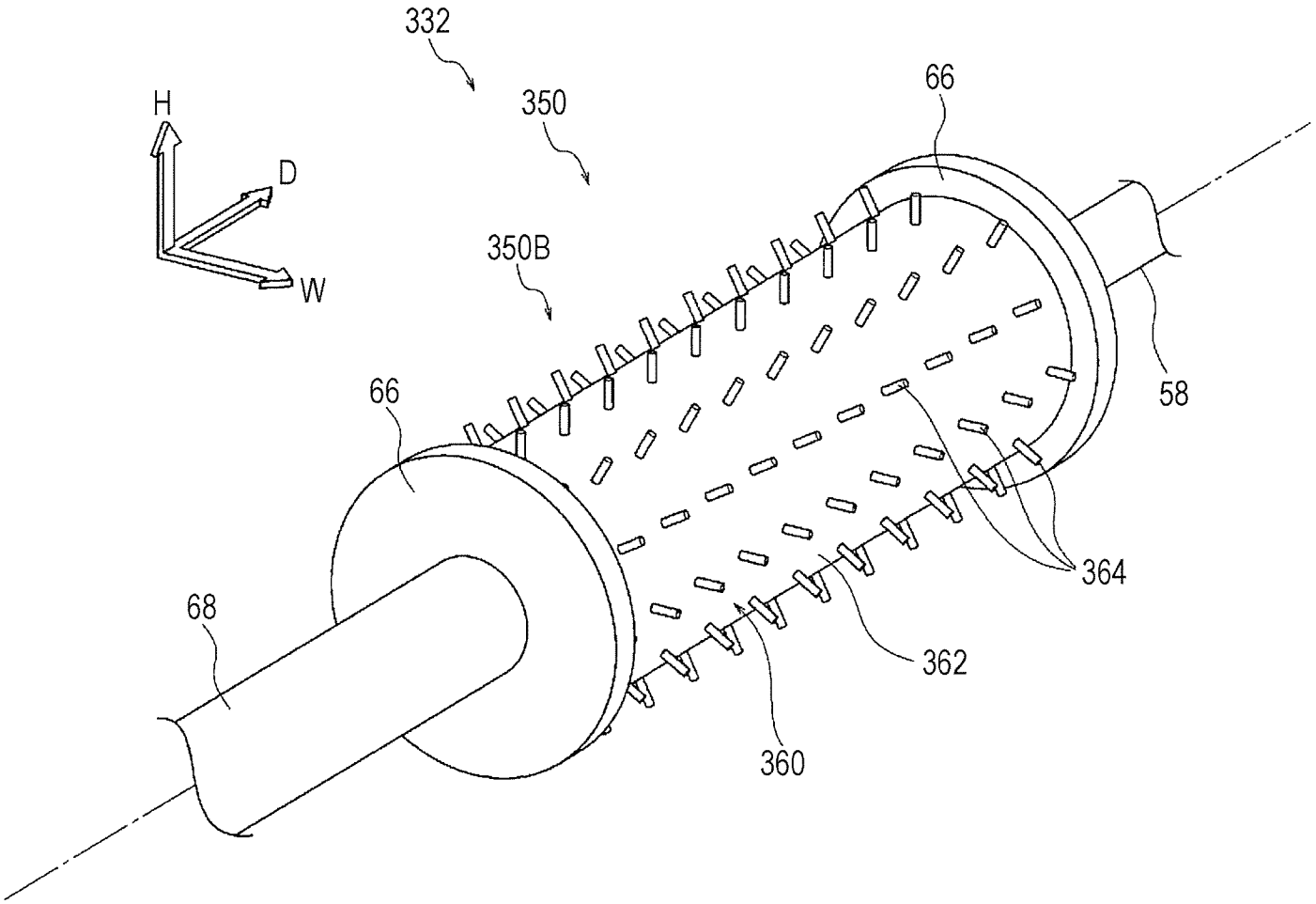
FIG. 13 is a perspective view of a magnetic roller provided in a developing device according to a third exemplary embodiment of the present invention.

As shown in FIG. 13, a sleeve 350B of a magnetic roller 350 in a developing device 332 according to the third exemplary embodiment includes a cylindrical body part 360 and projections 364 formed on a circumference 362 of the body part 360. The sleeve 350B also includes flanges 66 formed on both ends of the body part 360 in the depth direction of the apparatus and a shaft part 68 extending from the near side of the body part 360 in the depth direction of the apparatus. The sleeve 350B is an example of a rotary member.

The projections 364 have a cylindrical shape and project in the radial direction of the body part 360 from the circumference 362 of the body part 360. The projections 364 are formed at different positions in the circumferential direction and axial direction of the body part 360. In this exemplary embodiment, the height of the projections 364 is 0.7 mm.

The effect of the third exemplary embodiment is the same as that of the first exemplary embodiment, except for the effect provided by the wall surface facing downstream in the sleeve-rotation direction in the first exemplary embodiment.

Fourth Exemplary Embodiment

An example of a developing device and an example of an image forming apparatus according to a fourth exemplary embodiment of the present invention will be described below with reference to FIG. 14. The configuration of the fourth exemplary embodiment that differs from the first exemplary embodiment will be described.

Figure 14:
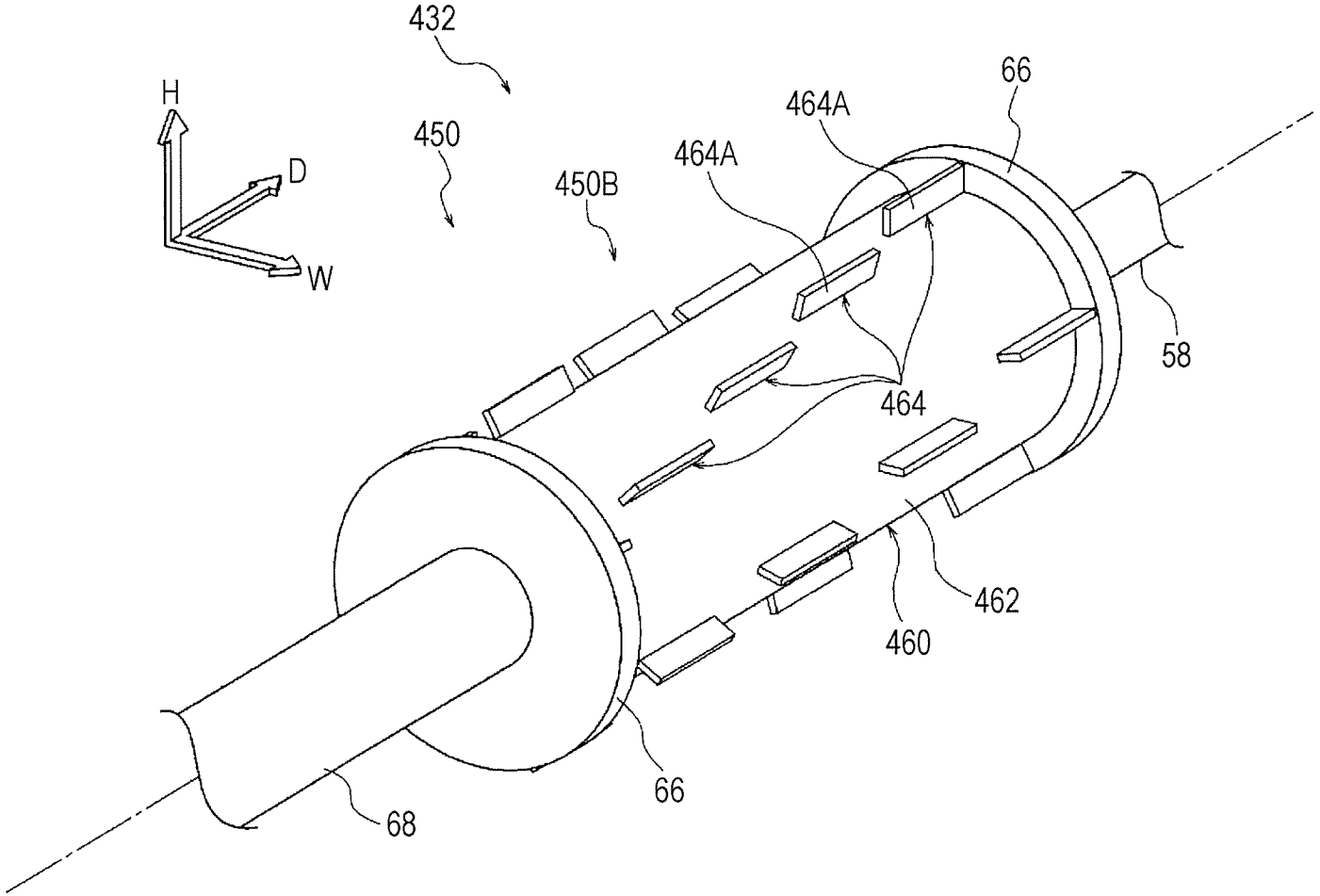
FIG. 14 is a perspective view of a magnetic roller provided in a developing device according to a fourth exemplary embodiment of the present invention.

As shown in FIG. 14, a sleeve 450B of a magnetic roller 450 provided in a developing device 432 according to the fourth exemplary embodiment has a cylindrical body part 460 and projections 464 formed on a circumference 462 of the body part 460. The sleeve 450B includes flanges 66 formed at both ends of the body part 460 in the depth direction of the apparatus and a shaft part 68 extending from the near side of the body part 460 in the depth direction of the apparatus. The sleeve 450B is an example of a rotary member.

The projections 464 have a plate-like shape extending in the depth direction of the apparatus and project in the radial direction of the body part 460 from the circumference 462 of the body part 460. The projections 464 are formed at different positions in the circumferential direction and axial direction of the body part 460. Each of the projections 464 has a wall surface 464A facing downstream in the sleeve-rotation direction. The wall surfaces 464A are an example of the outer wall surface.

The projections 464 are arranged such that an end of a projection 464 in the axial direction of the body part 460 overlaps an end of another projection 464 in the circumferential direction of the body part 460. In this exemplary embodiment, the height of the projections 464 is 0.7 mm. The effect of the fourth exemplary embodiment is the same as the effect of the first exemplary embodiment.

Although specific exemplary embodiments of the present invention have been described in detail, the present invention is not limited to these exemplary embodiments, and it is obvious to a person skilled in the art that various exemplary embodiments are possible within the scope of the present invention. For example, in the above-described exemplary embodiments, although the rotating magnetic rollers 50, 250, 350, and 450 transport the developer G at or beyond the threshold height H to accumulate the developer G in the supply port 70 to stop the supply of the toner T, any configuration that accumulates the excess developer G in the supply port 70 to stop the supply of the toner T may be used. Hence, a configuration that does not use the magnetic roller may also be used.

In the first exemplary embodiment, although one projection 64 is formed on the circumference 62 of the body 60, more than one projection 64 may be provided at intervals in the circumferential direction.

Although the sectional shape of the grooves 62A formed in the body 60 of the sleeve 50B according to the first exemplary embodiment is trapezoidal, the sectional shape of the grooves 62A may be a V shape or other shapes.

Although the frictional force between the toner T and the body 60 is increased by forming the grooves 62A in the body 60 of the sleeve 50B according to the first exemplary embodiment, the frictional force between the toner T and the body part may be increased by blasting the circumference of the body part or the like method.

In the above-described exemplary embodiments, although the supply path 40F and the passage 40G are disposed on the near side portion of the stirring path 40D in the depth direction of the apparatus, they may be disposed on the far side or at the center of the stirring path 40D in the depth direction of the apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container containing developer, into which toner is supplied from a supply port provided in an upper part of the container; and a rotary member disposed so as to oppose the supply port and having a projection on a circumference thereof, the rotary member transporting the developer and accumulating the developer in the supply port when a level of a surface of the developer inside the container is higher than or equal to a threshold height, and the rotary member transporting the toner from the supply port to the container through a path formed between the rotary member and the container by pushing the toner with the projection when the level of the surface is lower than the threshold height, wherein the rotary member has a flange that comes into contact with an inner wall surface constituting the path, a height of the flange being larger than a height of the projection.

2. The developing device according to claim 1, wherein the circumference has a plurality of grooves extending in an axial direction of the rotary member, the grooves being provided at equal intervals in a circumferential direction, and the height of the projection is larger than a depth of the grooves.

3. The developing device according to claim 1, wherein the projection has an outer wall surface facing downstream in a rotation direction of the rotary member.

4. The developing device according to claim 2, wherein the projection has an outer wall surface facing downstream in a rotation direction of the rotary member.

5. The developing device according to claim 1, wherein the flange is provided at a position different from a position of the supply port in an axial direction of the rotary member.

6. An image forming apparatus comprising:

an image carrier;

the developing device according to claim 1 that develops an electrostatic latent image formed on the image carrier into a toner image; and a transfer member that transfers the toner image on the image carrier to a recording medium.

* * * * *